US008646774B2

(12) United States Patent
Yoshinaga

(10) Patent No.: US 8,646,774 B2
(45) Date of Patent: Feb. 11, 2014

(54) SHEET TRANSPORT DEVICE HAVING GUIDE MEMBER, AND IMAGE FORMING APPARATUS INCLUDING THE SAME

(71) Applicant: Kyocera Document Solutions Inc., Osaka (JP)

(72) Inventor: Shinji Yoshinaga, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/689,024

(22) Filed: Nov. 29, 2012

(65) Prior Publication Data

US 2013/0134661 A1 May 30, 2013

(30) Foreign Application Priority Data

Nov. 30, 2011 (JP) ..... 2011-261535

(51) Int. Cl.
*B65H 5/00* (2006.01)
*B65H 39/10* (2006.01)
*B65H 9/00* (2006.01)

(52) U.S. Cl.
USPC ..... 271/225; 271/303; 271/226

(58) Field of Classification Search
USPC ..... 271/302–304, 225, 226, 253
See application file for complete search history.

(56) References Cited

U.S. PATENT DOCUMENTS

| | | | | | |
|---|---|---|---|---|---|
| 5,417,411 | A * | 5/1995 | Kubota et al. | 271/9.12 |
| 5,690,325 | A * | 11/1997 | Morimoto | 271/65 |
| 5,692,744 | A | 12/1997 | Funato | |
| 5,931,090 | A * | 8/1999 | Ohkawa | 101/118 |
| 6,098,536 | A * | 8/2000 | Ohkawa | 101/118 |
| 6,981,636 | B2 * | 1/2006 | Gallo-Hendrikx | 235/379 |
| 2010/0314827 | A1 * | 12/2010 | Nishii et al. | 271/264 |
| 2011/0089627 | A1 * | 4/2011 | Choi et al. | 271/109 |

FOREIGN PATENT DOCUMENTS

| | | |
|---|---|---|
| JP | 07-309476 | 11/1995 |
| JP | 2008-024520 | 2/2008 |
| JP | 2009-040539 | 2/2009 |

* cited by examiner

*Primary Examiner* — Patrick Cicchino
(74) *Attorney, Agent, or Firm* — K&L Gates LLP

(57) ABSTRACT

A sheet transport device includes a registration section, a first sheet transport path and a second sheet transport path the two transport directions of which are substantially perpendicular to the sheet transport direction of the registration section, a confluence transport path, and a first guide member. The confluence transport path merges the first sheet transport path and the second sheet transport path. The first guide member may rotate toward the first sheet transport path when the sheet is fed from the first sheet transport path to the confluence transport path. The first guide member may rotate toward the second sheet transport path when the sheet is fed from the second sheet transport path to the confluence transport path.

19 Claims, 9 Drawing Sheets

SHEET TRANSPORT DEVICE HAVING GUIDE MEMBER, AND IMAGE FORMING APPARATUS INCLUDING THE SAME

INCORPORATION BY REFERENCE

This application is based upon, and claims the benefit of priority from, corresponding Japanese Patent Application No. 2011-261535 filed Nov. 30, 2011, the entire contents of which is incorporated herein by reference.

BACKGROUND

The present disclosure relates to a sheet transport device that feeds a sheet in a predetermined direction, and an image forming apparatus including same, such as a copying machine, a printer, a fax machine, or a multifunctional peripheral having functions of them. The present disclosure also relates to a sheet transport device that feeds a sheet in a predetermined direction in a confluence transport path where a plurality of sheet transport paths merge, and an image forming apparatus including same.

An image forming apparatus is provided with a sheet transport device that feeds sheets in a paper cassette to a transfer section one at a time, feeds a sheet to which a toner image is transferred to a fixing section, and then feeds the sheet to an ejection section. This sheet transport device has a plurality of transport roller pairs. Due to the rotation of the transport roller pairs, a sheet is fed along a transport path. In such a sheet transport device, a sheet is fed to the transfer section at a predetermined timing, and the direction of the sheet to which an image is transferred is appropriately maintained. For example, the leading edge of the sheet comes into contact with the nip section of the registration roller pair and stops. Even after the leading edge of the sheet stops, the rear part of the sheet is fed. Thus, the sheet is curved. At this time, the rear part of the sheet is restrained by a transport roller pair. Therefore, if the leading edge of the sheet is skewed relative to the nip section, the leading edge of the sheet is aligned with the nip section of the registration roller pair, and the skew of the sheet is corrected.

Examples of such a sheet transport device that corrects the skew include a sheet transport device in which a sheet transport path on the upstream side of the registration roller pair is curved and that has a stationary guide member provided on the concave side of the curved sheet transport path. A movable guide member is provided on the convex side of the sheet transport path so as to face the stationary guide member and rotatably supported in the vicinity of the upstream end. A film-like member is provided that protrudes from the front edge of the movable guide member to the downstream side in the sheet transport direction. A spring urges the movable guide member toward the stationary guide member. In this sheet transport device, a sheet whose leading edge has reached the registration roller pair curves along the sheet transport path. At this time, the sheet is deflected toward the movable guide member, and the movable guide member is pressed by the convex side of the curved sheet, but the convex side of the sheet is held down by the spring. Therefore, the leading edge of the sheet is pressed against the nip section of the registration roller pair, and the skew of the sheet is corrected.

However, in the above sheet transport device, the contact of the sheet with the movable guide member increases the transport load. Therefore, it is necessary to use a high-performance motor, and this may increase the cost.

In another exemplary sheet transport device, a movable guide capable of being bent like a loop is provided on the upstream side of the registration roller pair. When the leading edge of the sheet comes into contact with the nip section of the registration roller pair, the sheet bends like a loop. The skew of the sheet is thereby corrected. The movable guide is pressed along the deflection of the sheet and is deformed like a loop. The sheet comes into contact with the movable guide before the movable guide forms a loop. This configuration may reduce the transport noise generated between the sheet and the movable guide.

Still another exemplary sheet transport device uses a plurality of sheet transport paths, and reduces the transport noise generated when a sheet transported from each sheet transport path comes into contact with the registration roller pair and undergoes deflection. In this sheet transport device, a guide member is provided in the sheet transport direction of each sheet transport path, and two elastic films are positioned so as to be in contact with the guide member. When a sheet comes into contact with the registration roller pair and undergoes deflection, the most bulging part of the sheet comes into contact with the area around the contact point of the two elastic films. Therefore, the sheet is not bent rapidly, and the vibration of the sheet is suppressed. This configuration reduces the transport noise.

SUMMARY

A sheet transport device according to an embodiment of the present disclosure includes a registration section, a first sheet transport path, a second sheet transport path, a confluence transport path, and a first guide member. The registration section may be configured to cause the leading edge of a sheet to come into contact with itself, thereby stop the sheet, and then transport the sheet again at a predetermined timing. The first sheet transport path may be configured to feed the sheet from one of two transport directions substantially perpendicular to the sheet transport direction of the registration section. The second sheet transport path may be configured to feed the sheet from the other of the two transport directions substantially perpendicular to the sheet transport direction. The confluence transport path may be configured to merge the first sheet transport path and the second sheet transport path on the upstream side of the registration section in the sheet transport direction. The first guide member may be positioned so as to form the confluence transport path such that the space in the confluence transport path becomes smaller from the upstream side toward the downstream side in the sheet transport direction, and may be rotatable about a rotation center on the side of the registration section to the upstream side of the first guide member in the sheet transport direction. The first guide member may rotate toward the first sheet transport path in the case where the sheet is fed from the first sheet transport path to the confluence transport path. The first guide member may rotate toward the second sheet transport path in the case where the sheet is fed from the second sheet transport path to the confluence transport path.

An image forming apparatus according to another embodiment of the present disclosure includes a recording section, and the above sheet transport device.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
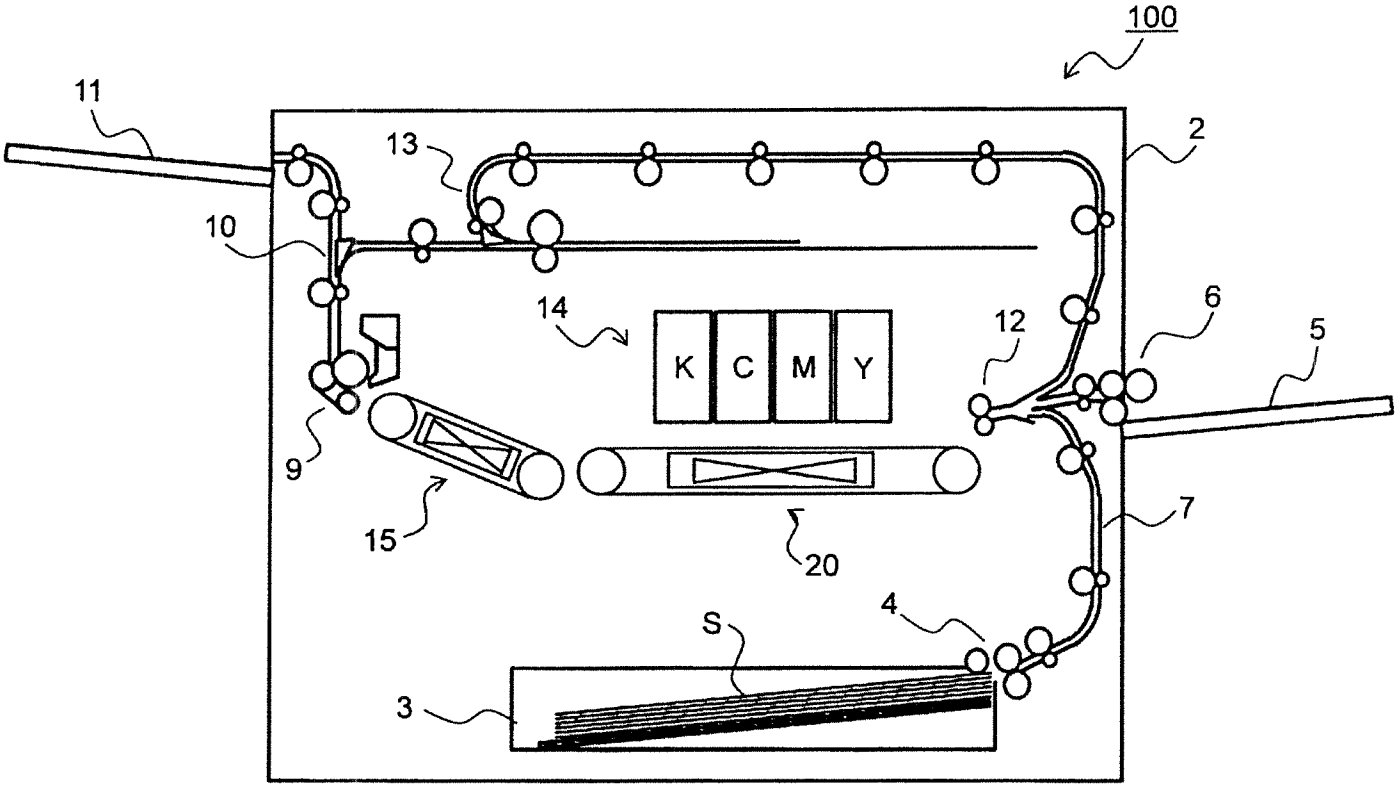
FIG. 1 is a side sectional view showing the internal configuration of an image forming apparatus, including a sheet transport device, of an embodiment of the present disclosure.

Example apparatus and unit are described herein. Other example embodiments or features may be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

An embodiment of the present disclosure will be described below with reference to the drawings. However, the present disclosure is not limited to this embodiment. The application of the disclosure and terms and the like shown here are not limited to this.

FIG. 1 is a side sectional view showing the internal configuration of an ink-jet printer 100 that is an example of an image forming apparatus according to an embodiment of the present disclosure. The printer 100 has a paper cassette 3 located in the lower part of the inside of an apparatus main body 2. The paper cassette 3 is a sheet storing section. A predetermined number of (for example, about 500) sheets S of unprinted cut paper or the like are loaded and stored in the paper cassette 3. A paper feed section 4 is located on the downstream side in the sheet transport direction of the paper cassette 3, that is, to the upper right of the paper cassette 3 in FIG. 1. The paper feed section 4 separates and sends out the sheets S one at a time toward the upper right of the paper cassette 3 in FIG. 1. The paper cassette 3 can be pulled out horizontally from the front of the apparatus main body 2 and replenished with sheets S.

A manual paper feed tray 5 is provided on the right side surface of the apparatus main body 2. Sheets S, such as sheets that differ in size from the sheets S in the paper cassette 3, sheets of thick paper, OHP sheets, envelopes, or invoices, may be loaded on the manual paper feed tray 5. A sheet transport path 6 is located on the downstream side in the sheet transport direction of the manual paper feed tray 5, that is, on the left side of the manual paper feed tray 5 in FIG. 1. The sheets S on the manual paper feed tray 5 are separated and sent out one at a time from the sheet transport path 6 toward the left side in FIG. 1.

The printer 100 has a sheet transport path 7 therein. The sheet transport path 7 is located to the upper right of the paper cassette 3. The sheet S sent out from the paper cassette 3 is fed by the sheet transport path 7 along the side surface of the apparatus main body 2 vertically upward. The sheet S sent out from the manual paper feed tray 5 is fed by the sheet transport path 6 substantially horizontally toward the left of the apparatus main body 2.

A registration roller pair 12 is provided at the downstream ends of the sheet transport paths 6 and 7 in the sheet transport direction. In addition, a first belt transport section 20 and a recording section 14 are located immediately downstream of the registration roller pair 12. The sheet S sent out from the paper cassette 3 passes through the sheet transport path 7 and reaches the registration roller pair 12. The sheet S sent out from the manual paper feed tray 5 passes through the sheet transport path 6 and reaches the registration roller pair 12. While correcting the skew of the sheet S, the registration roller pair 12 sends out the sheet S toward the first belt transport section 20 in timed relationship with the ink ejecting operation performed by the recording section 14. Transport roller pairs that feed the sheet S are positioned in appropriate places in the sheet transport paths 6 and 7.

A second belt transport section 15 is located on the downstream side of the first belt transport section 20 in the sheet transport direction (on the left side of the first belt transport section 20 in FIG. 1). The sheet S on which an ink image has been recorded in the recording section 14 is sent to the second belt transport section 15. While the sheet S passes through the second belt transport section 15, the ink ejected onto the surface of the sheet S is dried.

A decurler section 9 is provided on the downstream side of the second belt transport section 15 in the sheet transport direction and in the vicinity of the left side surface of the apparatus main body 2. After the ink is dried in the second belt transport section 15, the sheet S is sent to the decurler section 9, and curl is corrected using a plurality of rollers positioned in the sheet width direction.

A sheet transport path 10 is located on the downstream side of the decurler section 9 in the sheet transport direction (above the decurler section 9 in FIG. 1). In the case where duplex recording is not performed, the sheet S passing through the decurler section 9 is ejected from the sheet transport path 10 onto a sheet ejection tray 11 provided on the left side surface of the printer 100.

A reversing transport path 13 is located in the upper part of the apparatus main body 2 and above the recording section 14 and the second belt transport section 15. The reversing transport path 13 reverses the sheet S when duplex recording is performed. In the case where duplex recording is performed, after recording on a first side of the sheet S is completed, the sheet S passes through the second belt transport section 15 and the decurler section 9 and is sent through the sheet transport path 10 to the reversing transport path 13. After the sheet S is sent to the reversing transport path 13, the transport direction of the sheet S is reversed for the purpose of performing recording on a second side opposite to the first side, and the sheet S is sent through the upper part of the apparatus main body 2 to the right side in FIG. 1. After that, the sheet S is sent vertically downward, and is sent through the registration roller pair 12 to the first belt transport section 20 again with the second side up.

Figure 2:
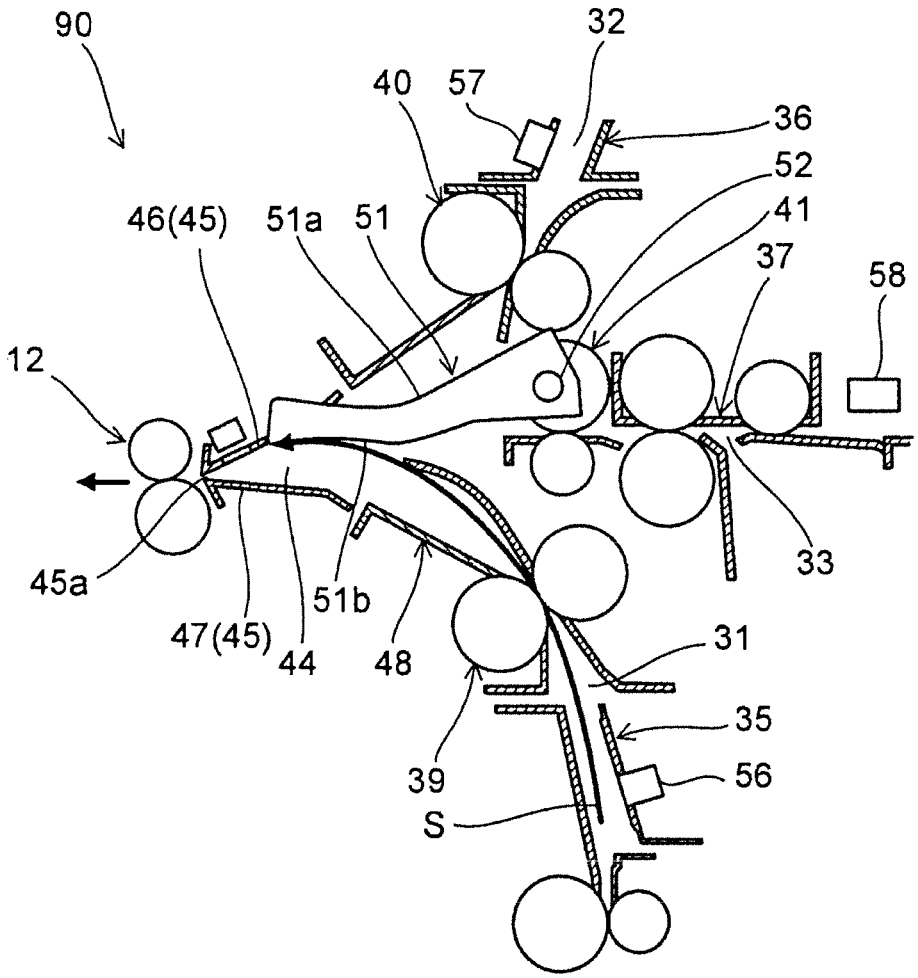
FIG. 2 is a schematic view, from below, showing sheet transport paths around a registration section of the sheet transport device, of an embodiment of the present disclosure, at the time of sheet transportation.
Figure 3:
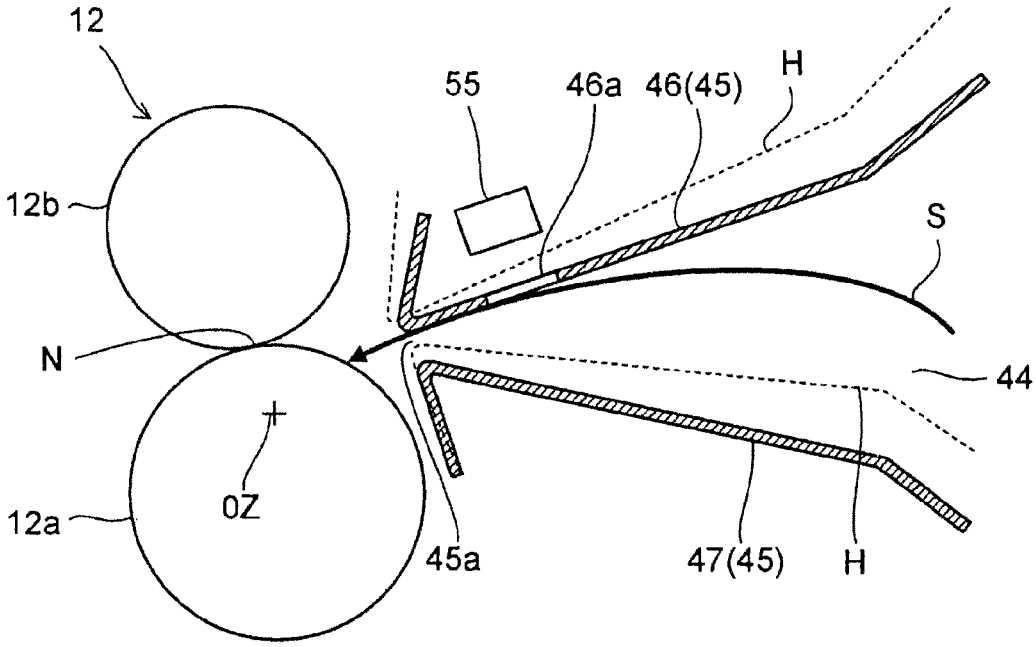
FIG. 3 is a schematic view, from below, showing a confluence transport path of the sheet transport device, of an embodiment of the present disclosure, at the time of sheet transportation.
Figure 4:
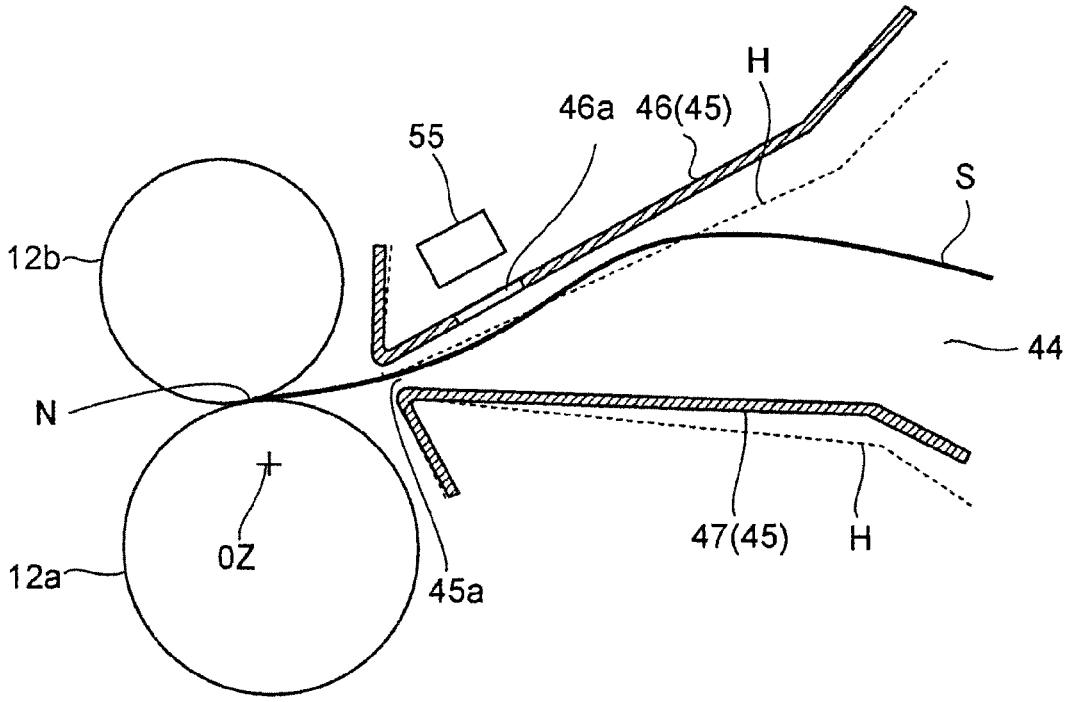
FIG. 4 is a schematic view, from below, showing the confluence transport path of the sheet transport device, of an embodiment of the present disclosure, at the time of re-transportation by the registration section of a sheet transported.
Figure 5:
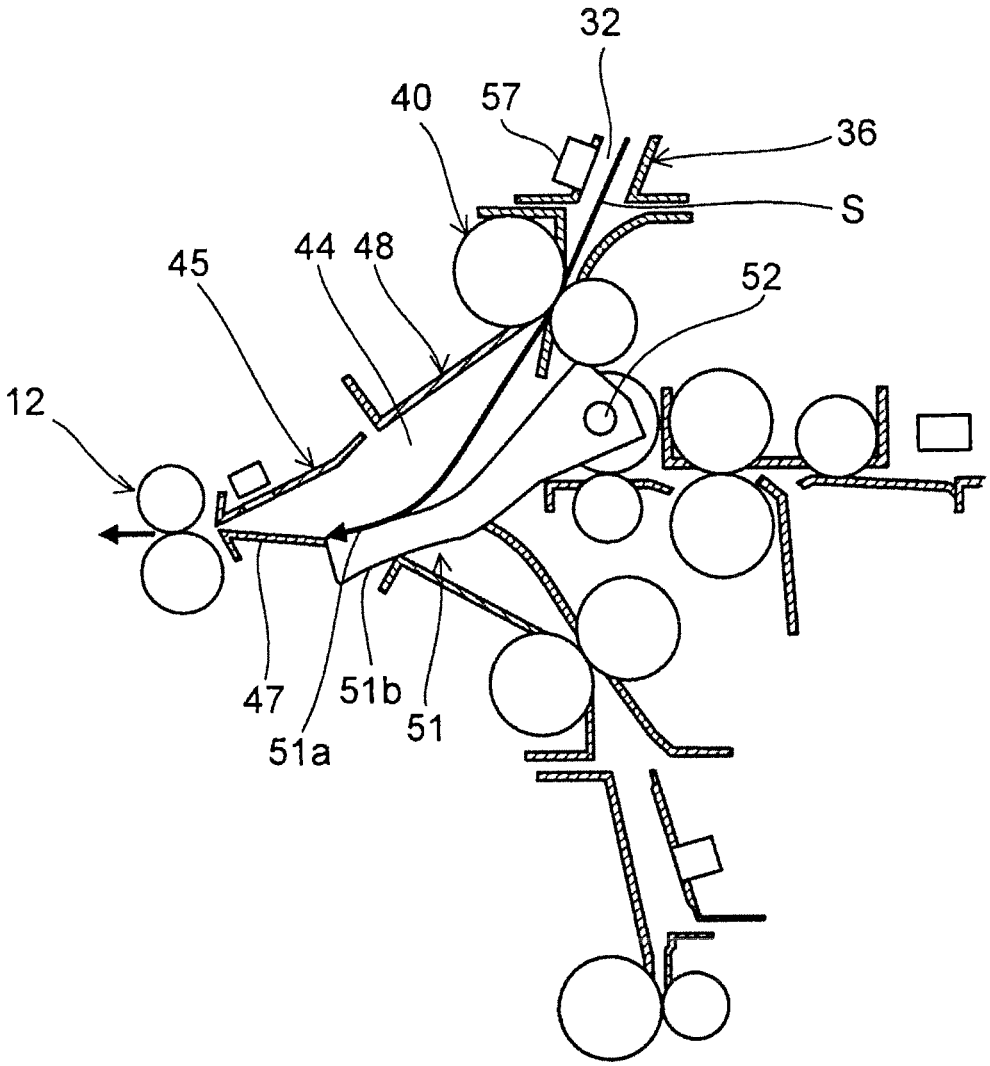
FIG. 5 is an elevational schematic view showing the sheet transport paths around the registration section of the sheet transport device, of an embodiment of the present disclosure, at the time of sheet transportation.
Figure 6:
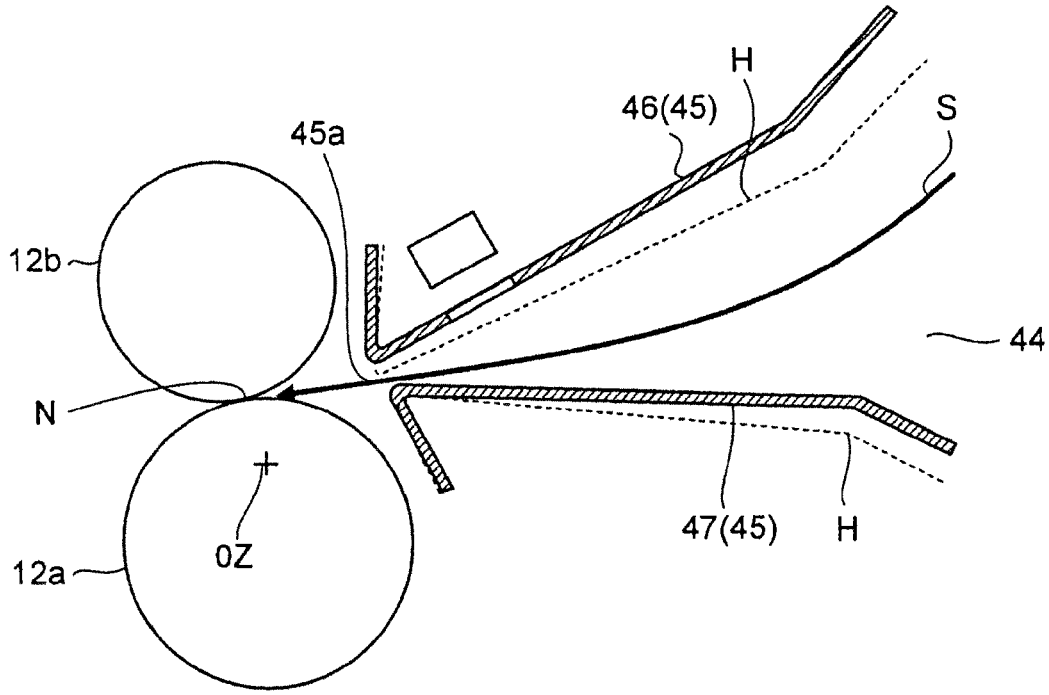
FIG. 6 is an elevational schematic view showing the confluence transport path of the sheet transport device, of an embodiment of the present disclosure, at the time of sheet transportation.
Figure 7:
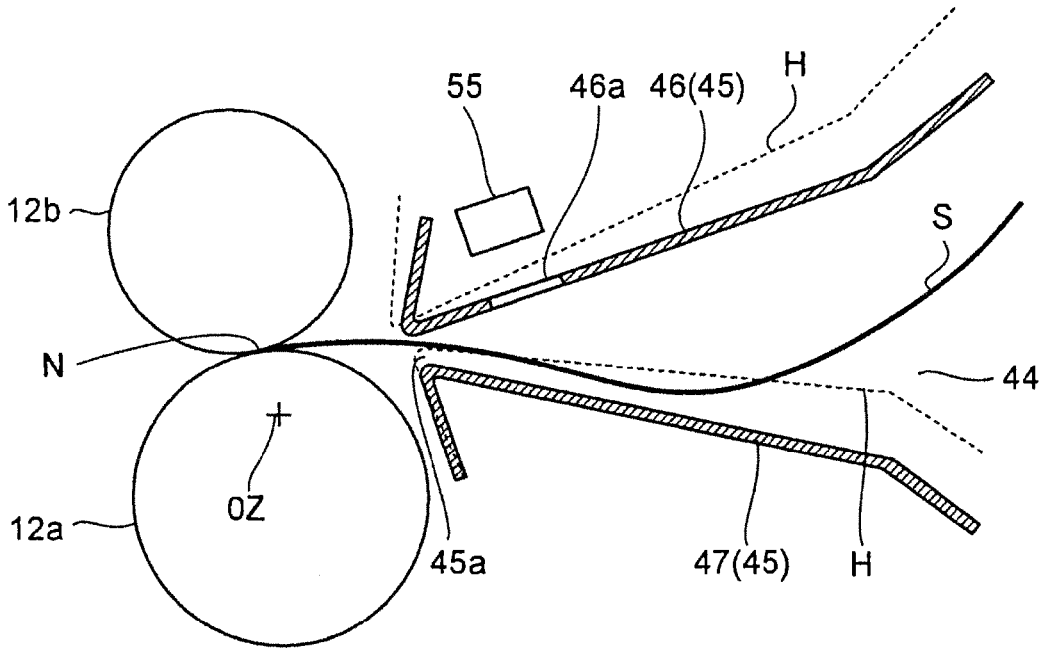
FIG. 7 is an elevational schematic view showing the confluence transport path of the sheet transport device, of an embodiment of the present disclosure, at the time of re-transportation by the registration section of a sheet transported.
Figure 8:
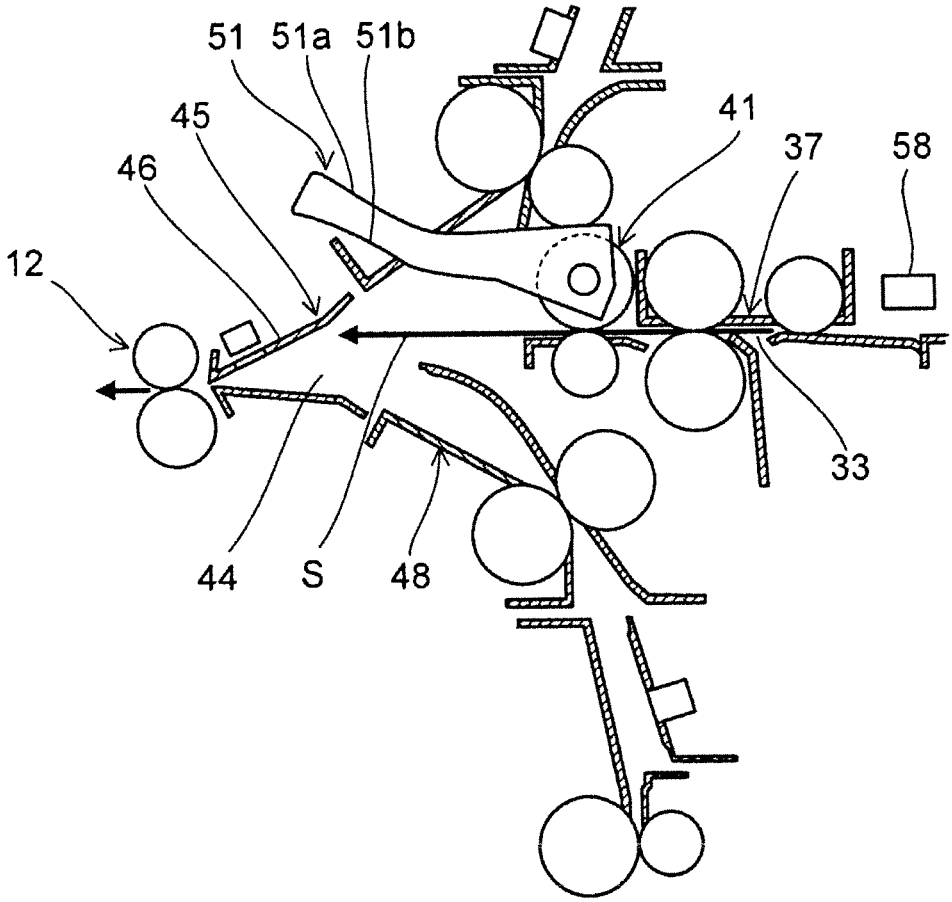
FIG. 8 is a schematic view from the horizontal direction showing the sheet transport paths around the registration section of the sheet transport device of an embodiment of the present disclosure, at the time of sheet transportation.
Figure 9:
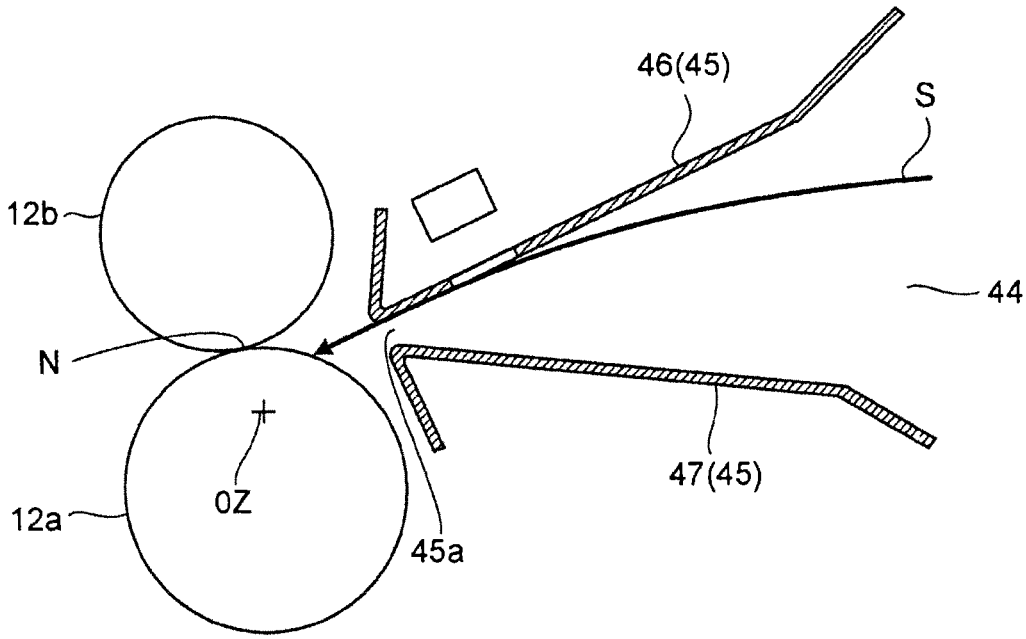
FIG. 9 is a schematic view from the horizontal direction showing the confluence transport path of the sheet transport device, of an embodiment of the present disclosure, at the time of sheet transportation.

A sheet transport device 90 that feeds the sheet to the registration roller pair 12 will be described with reference to FIG. 2 to FIG. 9. FIG. 2 to FIG. 4 are schematic sectional views showing the configuration in the case where the sheet S is fed from the lower part of the apparatus main body 2 to the registration roller pair 12. FIG. 5 to FIG. 7 are schematic sectional views showing the configuration in the case where the sheet S is transported from the upper part of the apparatus main body 2 to the registration roller pair 12. FIG. 8 and FIG. 9 are schematic sectional views showing the configuration in the case where the sheet S is fed from the horizontal direction of the apparatus main body 2 to the registration roller pair 12. In the figures showing the configuration in the case where the sheet S is fed from each direction, FIG. 2, FIG. 5, and FIG. 8 are diagrams showing the configuration in the case where the sheet S is fed to a confluence transport path 44, FIG. 3, FIG. 6, and FIG. 9 are diagrams showing the configuration in the case where the sheet S is fed from the confluence transport path 44 to the registration roller pair 12, and FIG. 4 and FIG. 7 are diagrams showing the configuration in the case where the sheet S is re-fed from the registration roller pair 12.

As shown in FIG. 2, the sheet transport device 90 includes a registration roller pair 12 that is a registration section, and a plurality of sheet transport paths composed of a lower transport path 31 that corresponds to a first transport path that feeds the sheet S substantially from below, an upper transport path 32 that corresponds to a second transport path that feeds the sheet S substantially from above, and a horizontal transport path 33 that corresponds to a third transport path that feeds the sheet S substantially from the horizontal direction. The registration roller pair 12 feeds sheet S in a substantially horizontal direction. The lower transport path 31 and the upper transport path 32 feed the sheet S from a direction substantially perpendicular to the substantially horizontal direction in which the registration roller pair 12 feeds the sheet S. The sheet transport device 90 further includes a confluence transport path 44 that is located on the downstream side of the transport paths 31 to 33 and on the upstream side of the registration roller pair 12 in the sheet transport direction and where the transport paths 31 to 33 merge into a single transport path. The above substantially perpendicular transport direction is, for example, a direction within a range of ±20° with respect to the perpendicular direction.

The sheet S sent out from the paper cassette 3 (see FIG. 1) is fed through the lower transport path 31 and the confluence transport path 44 to the registration roller pair 12. In the case of duplex printing, the sheet S is reversed and then fed through the upper transport path 32 and the confluence transport path 44 to the registration roller pair 12. The sheet S sent out from the manual paper feed tray 5 (see FIG. 1) is fed through the horizontal transport path 33 and the confluence transport path 44 to the registration roller pair 12.

The lower transport path 31 includes a pair of lower guide members 35 and a lower transport roller pair 39. The pair of lower guide members 35 are located at a distance from each other, face each other, and guide the sheet S to the confluence transport path 44. The lower transport roller pair 39 is located on the downstream side in the sheet transport direction of the lower guide members 35 and sends out the sheet S to the confluence transport path 44. Due to the rotation of the lower transport roller pair 39, the sheet S is fed to the confluence transport path 44 while being guided by the lower guide members 35 and is then fed to the registration roller pair 12. One of the lower guide members 35 extends to the downstream side of the lower transport roller pair 39 and causes the sheet S to curve toward the registration roller pair 12.

The upper transport path 32 includes a pair of upper guide members 36 and an upper transport roller pair 40. The pair of upper guide members 36 are located at a distance from each other, face each other, and guide the sheet S to the confluence transport path 44. The upper transport roller pair 40 is located on the downstream side in the sheet transport direction of the upper guide members 36 and sends out the sheet S to the confluence transport path 44. Due to the rotation of the upper transport roller pair 40, the sheet S is fed to the confluence transport path 44 while being guided by the upper guide members 36 and is then fed to the registration roller pair 12. One of the upper guide members 36 extends to the downstream side of the upper transport roller pair 40 and causes the sheet S to curve toward the registration roller pair 12.

The horizontal transport path 33 includes a pair of horizontal guide members 37 and a horizontal transport roller pair 41. The pair of horizontal guide members 37 are located at a distance from each other, face each other, and guide the sheet S to the confluence transport path 44. The horizontal transport roller pair 41 is located on the downstream side in the sheet transport direction of the horizontal guide members 37 and sends out the sheet S to the confluence transport path 44. Due to the rotation of the horizontal transport roller pair 41, the sheet S is fed to the confluence transport path 44 while being guided by the horizontal guide members 37 and is then fed to the registration roller pair 12.

The confluence transport path 44 includes a first guide member 45 that is located so as to face the registration roller pair 12 and is rotatable, and a stationary guide member 48 located on the upstream side in the sheet transport direction of the first guide member 45.

The stationary guide member 48 is composed of a pair of guides, which are arranged in a "V" shape in cross-section. That is to say, the pair of guides are arranged such that the ends thereof on the upstream side in the sheet transport direction are located in the vicinity of the lower transport roller pair 39 and the vicinity of the upper transport roller pair 40, and the space of the confluence transport path 44 becomes narrower toward the downstream side in the sheet transport direction. Therefore, the sheet S fed from the lower transport path 31 is guided into the confluence transport path 44 by the stationary guide member 48. The sheet S fed from the upper transport path 32 is guided into the confluence transport path 44 by the stationary guide member 48. The sheet S fed from the horizontal transport path 33 is guided into the confluence transport path 44 by the stationary guide member 48.

The first guide member 45 includes a first upper guide section 46 and a first lower guide section 47. The first upper guide section 46 and the first lower guide section 47 are arranged in a "V" shape in cross-section. The sheet S guided into the confluence transport path 44 by the stationary guide member 48 is guided toward the registration roller pair 12 by the first guide member 45.

That is to say, the first guide member 45 is arranged such that one end of the first upper guide section 46 on the upstream side in the sheet transport direction is located in the vicinity of the upper guide of the stationary guide member 48 (more specifically, in the vicinity of the end of the upper guide of the stationary guide member 48 on the downstream side in the sheet transport direction), and one end of the first lower guide section 47 on the upstream side in the sheet transport direction is located in the vicinity of the lower guide of the stationary guide member 48 (more specifically, in the vicinity of the end of the lower guide of the stationary guide member 48 on the downstream side in the sheet transport direction). The first upper guide section 46 and the first lower guide section 47 are arranged so as to approach each other from one end toward the other end. In the example shown in FIG. 2, the first upper guide section 46 and the first lower guide section 47 are arranged so as to approach each other from the upstream end toward the downstream end in the transport direction. The other ends (the downstream ends in the transport direction in the example shown in FIG. 2) of the first upper guide section 46 and the first lower guide section 47 form a relatively small space and form a send-out opening 45*a* facing the registration roller pair 12.

Therefore, the sheet S fed from the lower transport path 31 through the space between the pair of guides of the stationary guide member 48 (that is to say, the space between the upper guide and the lower guide of the stationary guide member 48) is guided to the send-out opening 45*a* by the surface in the confluence transport path 44 of the first upper guide section 46. The sheet S fed from the upper transport path 32 through the stationary guide member 48 is guided to the send-out opening 45*a* by the surface in the confluence transport path 44 of the first lower guide section 47 (see, for example, FIG. 5). In the case where the sheet S is fed from the lower transport path 31, the first guide member 45 rotates toward the direction from which the sheet S is fed, that is, downwardly. In the case where the sheet S is fed from the upper transport path 32, the first guide member 45 rotates in the direction from which the sheet S is fed, that is, upwardly. This configuration reduces the collision noise generated when the sheet S collides with the first upper guide section 46 or the first lower guide section 47. This configuration will be described later.

A second guide member 51 is located in the confluence transport path 44. The sheet S fed from the lower transport path 31 or the upper transport path 32 is guided toward the first guide member 45 by the second guide member 51. The second guide member 51 has a lower guide surface 51*b* that is a first guide surface, and an upper guide surface 51*a* that is a second guide surface formed on the opposite side from the lower guide surface 51*b*, and has an angled shape in cross-section. The upper guide surface 51*a* is formed on the upper side of the second guide member 51, and the lower guide surface 51*b* is formed on the lower side of the second guide member 51. A plurality of such second guide members 51 may be arranged in a direction (the width direction of the sheet S) perpendicular to the sheet transport direction. The second guide member 51 rotates about a rotation axis 52. The rotation axis 52 is located on the upstream side in the sheet transport direction of the confluence transport path 44 and in the vicinity of the horizontal transport path 33. Grooves, such as cutouts, may be formed in the first guide member 45 and the stationary guide member 48 according to the movement locus of the second guide member 51. When the second guide member 51 rotates, the grooves prevent the second guide member 51 from colliding with the first guide member 45 and the stationary guide member 48.

The sheet S fed from the lower transport path 31 is guided to the first upper guide section 46 of the first guide member 45 by the lower guide surface 51*b* of the second guide member 51. The lower guide surface 51*b* is concave as shown, for example, in FIG. 2. In the case where the sheet S is fed from the lower transport path 31, when the passage of the sheet S is detected by a sheet detecting member 56 including a photosensor, a cantilever, or the like located in the lower transport path 31, the second guide member 51 rotates about the rotation axis 52 driven by a drive source such as a motor (not shown). Thus, as shown in FIG. 2, the end of the lower guide surface 51*b* stops at a position where it faces the first upper guide section 46.

Due to the above configuration, the sheet S is fed by rotation of the lower transport roller pair 39, while being guided by the lower guide members 35, from the lower transport path 31 to the confluence transport path 44. As described above, when the sheet S is fed from the lower guide members 35, the second guide member 51 rotates upwardly. Therefore, the sheet S fed to the confluence transport path 44 comes into contact with the lower guide surface 51*b* of the second guide member 51 at a relatively small angle. Thus, the collision noise generated when the sheet S comes into contact with the lower guide surface 51*b* can be reduced. It is preferable to form the lower guide surface 51*b* such that the angle at which the sheet S comes into contact with the lower guide surface 51*b* is, for example, 40° or less. It is more preferable to form the lower guide surface 51*b* such that the angle at which the sheet S comes into contact with the lower guide surface 51*b* is 30° or less. Since the lower guide surface 51*b* is concave, the sheet S is smoothly guided to the first upper guide section 46.

Depending on the arrangement and configuration of the lower transport path 31, the upper transport path 32, and the horizontal transport path 33 relative to the confluence transport path 44, the rotation axis 52 may be located further upstream of the horizontal transport path 33, or may be located on the side of the confluence transport path 44 formed by the stationary guide member 48, or may be provided above or below the horizontal transport path 33.

As shown in FIG. 3, the registration roller pair 12 and a sheet detecting sensor 55 are positioned around the first guide member 45.

The registration roller pair 12 corrects the skew of the sheet S sent from the send-out opening 45*a* of the first guide member 45. The registration roller pair 12 has a driving roller 12*a* that is a first roller, and a driven roller 12*b* that is a second roller. The driven roller 12*b* is formed of a material such as rubber. The driven roller 12*b* is pressed against the driving roller 12*a* and is rotationally driven by the rotation of the driving roller 12*a* while forming a nip section N. The driving roller 12*a* may be formed so that a surface friction coefficient may be lower than that of the driven roller 12*b*. This configuration may be constructed by employing, for example, aluminum or polyacetal resin as a material of driving roller 12*a*. The driving roller 12*a* is located, for example, under the driven roller 12*b*.

When the rotation of the registration roller pair 12 is stopped, the sheet S is fed by the transport roller pair 39, 40, or 41 (see FIG. 2), and the leading edge of the sheet S comes into contact with the nip section N. In this state, the rear part of the sheet S is fed further by the transport roller pair 39, 40, or 41, and the sheet S is thereby curved. At this time, the rear part of the sheet S is restrained by the transport roller pair 39, 40, or 41. Therefore, if the leading edge of the sheet S is skewed relative to the nip section N, the leading edge of the sheet S is aligned with the nip section N of the registration roller pair 12, and the skew of the sheet S is corrected. After the lapse of a first predetermined time until when the sheet S reaches the nip section N and the skew is corrected since the detection of the passage of the sheet S by the sheet detecting sensor 55, the registration roller pair 12 starts rotating, and feeds the sheet S together with the transport roller pair 39, 40, or 41.

As described above, the first guide member 45 rotates upward and downward with the first upper guide section 46 and the first lower guide section 47 being integral with each other. The rotation center OZ of the first guide member 45 is located on the side of the registration roller pair 12. That is, the rotation center OZ of the first guide member 45 is provided on the side of the registration roller pair 12 to the upstream side of the first guide member 45 in the sheet transport direction. More specifically, the rotation center OZ of the first guide member 45 is provided under the nip section N of the registration roller pair 12. The first guide member 45 rotates about the rotation center OZ within a range between a lower rotational position shown in FIG. 3 and FIG. 7 below the reference position H and an upper rotational position shown in FIG. 4 and FIG. 6 above the reference position H, and is configured to stop at the lower rotational position, the upper rotational, and a position therebetween. The first guide member 45 may stop at the upper rotational position (second rotational position), the lower rotational position (first rotational position), and a position between the upper rotational position and the lower rotational position. The first guide member 45 stops at the reference position H shown in FIG. 3 as a position between the upper rotational position and the lower rotational position. As described later, in the case where the sheet S is fed from the lower transport path 31 (first sheet transport path), the first guide member is located (stops) at the lower rotational position (first rotational position). In the case where the sheet S is fed from the upper transport path 32 (second sheet transport path), the first guide member is located (stops) at the upper rotational position (second rotational position). In the case where the sheet S is fed from the horizontal transport path 33 (third sheet transport path), the first guide member is located (stops) at the reference position H (position between the first rotational position and the second rotational position).

When the passage of the sheet S through the lower transport path 31 is detected by a sheet detecting member 56 located in the lower transport path 31 (see FIG. 2), the first guide member 45 is caused to rotate downwardly about the rotation center OZ by a drive source such as a motor (not shown), and stops at the position shown in FIG. 3.

Due to the downward rotation of the first guide member 45, the sheet S guided by the second guide member 51 (see FIG. 2) comes into contact with the first upper guide section 46 at a relatively small angle. Thus, the collision noise generated when the sheet S comes into contact with the first upper guide section 46 can be reduced. It is preferable to form the first upper guide section 46 such that the angle at which the sheet S comes into contact with the first upper guide section 46 is, for example, 40° or less. It is more preferable to form the first upper guide section 46 such that the angle at which the sheet S comes into contact with the first upper guide section 46 is 30° or less.

The downward rotation of the first guide member 45 moves the send-out opening 45*a* downwardly. Thus, the sheet S guided by the first upper guide section 46 and sent through the send-out opening 45*a* comes into contact with the driving roller 12*a* of the registration roller pair 12 at a relatively small angle. Therefore, the collision noise generated when the sheet S comes into contact with the driving roller 12*a* is reduced. Frequent contact of the sheet S with the driven roller 12*b* formed, for example, of rubber of the registration roller pair 12 may deteriorate the driven roller 12*b*. If the sheet S comes into contact with a roller having a relatively high frictional coefficient such as a roller made of rubber, the leading edge of the sheet S coming into contact with the roller may be folded. In this embodiment, the sheet S comes into contact with the driving roller 12*a*, which has a relatively low frictional coefficient. Therefore, damage to the roller due to contact with the sheet S is less likely to occur, and the leading edge of the sheet S is prevented from being folded.

After the sheet S comes into contact with the driving roller 12*a*, the rear part of the sheet S is further transported. The sheet S slides on the surface of the driving roller 12*a* and comes into contact with the nip section N as shown in FIG. 4.

Next, after the lapse of a second predetermined time that is shorter than the time until when the skew of the sheet S is corrected (first predetermined time) since the arrival of the sheet S at the nip section N, the first guide member 45 rotates upwardly about the rotation center OZ driven by a drive source such as a motor, and moves to the position shown in FIG. 4 above the reference position H.

After the sheet S reaches the nip section N, the first guide member 45 rotates upwardly. Therefore, even if the sheet S is curved in an upwardly convex manner for the purpose of the correction of the skew, the curved part of the sheet S is prevented from rubbing against the first upper guide section 46. Therefore, the rubbing noise generated by rubbing against the first guide member 45 at the time of sheet skew correction is reduced. In addition, since the lower guide surface 51*b* of the second guide member 51 (see FIG. 2) is concave, the rubbing of the curved part of the sheet S against the lower guide surface 51*b* is reduced, and the rubbing noise is reduced.

After the sheet S reaches the nip section N, the first guide member 45 rotates upwardly, and the send-out opening 45*a* is thereby moved upwardly. Thus, when, after the skew of the sheet S is corrected, the sheet S is fed by rotation of the registration roller pair 12, the sheet S is prevented from coming into contact with the edge of the send-out opening 45*a*. Therefore, the rubbing noise generated by the rubbing of the sheet S against the edge of the send-out opening 45*a* is reduced.

As shown in FIG. 5, in the case where the sheet S is fed from the upper transport path 32, when the passage of the sheet S is detected by a sheet detecting member 57 including a photosensor, a cantilever, or the like located in the upper transport path 32, the second guide member 51 rotates about the rotation axis 52 driven by a drive source such as a motor (not shown), and the end of the upper guide surface 51*a* stops at a position where it faces the first lower guide section 47 as shown in FIG. 5. More specifically, the end of the upper guide surface 51*a* of the second guide member 51 on the downstream side in the transport direction stops at a position where it faces the vicinity of the end of the first lower guide section 47 on the upstream side in the transport direction.

Due to the above configuration, the sheet S is fed by rotation of the upper transport roller pair 40, while being guided by the upper guide members 36, from the upper transport path 32 to the confluence transport path 44. As described above, when the sheet S is fed from the upper guide members 36, the second guide member 51 rotates downwardly. Therefore, the sheet S fed to the confluence transport path 44 comes into contact with the upper guide surface 51*a* of the second guide member 51 at a relatively small angle. Thus, the collision noise generated when the sheet S comes into contact with the upper guide surface 51*a* can be reduced. It is preferable to form the upper guide surface 51*a* such that the angle at which the sheet S comes into contact with the upper guide surface 51*a* is 40° or less. It is more preferable to form the upper guide surface 51*a* such that the angle at which the sheet S comes into contact with the upper guide surface 51*a* is 30° or less. The upper guide surface 51*a* is concave, and therefore the sheet S is guided to the first lower guide section 47 smoothly.

When the passage of the sheet S through the upper transport path 32 is detected by a sheet detecting member 57 located in the upper transport path 32, the first guide member 45 rotates upwardly about the rotation center OZ by a drive source such as a motor (not shown), and stops at the position shown in FIG. 6.

As shown in FIG. 6, due to the upward rotation of the first guide member 45, the sheet S guided by the second guide member 51 (see FIG. 5) comes into contact with the first lower guide section 47 at a relatively small angle. Thus, the collision noise generated when the sheet S comes into contact with the first lower guide section 47 can be reduced. It is preferable to form the first lower guide section 47 such that the angle at which the sheet S comes into contact with the first lower guide section 47 is 40° or less. It is more preferable to form the first lower guide section 47 such that the angle at which the sheet S comes into contact with the first lower guide section 47 is 30° or less.

The upward rotation of the first guide member 45 moves the send-out opening 45*a* upwardly. Thus, the sheet S guided by the first lower guide section 47 and sent through the send-out opening 45*a* comes into contact with the driving roller 12*a* of the registration roller pair 12 at a relatively small angle. Therefore, the collision noise generated when the sheet S comes into contact with the driving roller 12*a* is reduced. Frequent contact of the sheet S with the driven roller 12*b* formed, for example, of rubber of the registration roller pair 12 may deteriorate the driven roller 12*b*. If the sheet S comes into contact with a roller having a relatively high frictional coefficient such as a roller made of rubber, the leading edge of the sheet S coming into contact with the roller may be folded. In this embodiment, the sheet S comes into contact with the driving roller 12*a*, which has a relatively low frictional coefficient. Therefore, the damage of the roller due to the contact with the sheet S is less likely to occur, and the leading edge of the sheet S is prevented from being folded.

After the sheet S comes into contact with the driving roller 12*a*, the rear part of the sheet S is further fed. The sheet S slides on the surface of the driving roller 12*a* and comes into contact with the nip section N as shown in FIG. 7.

Next, after the lapse of a second predetermined time that is shorter than the first predetermined time until when the skew of the sheet S is corrected since the arrival of the sheet S at the nip section N, the first guide member 45 rotates downwardly about the rotation center OZ driven by a drive source such as a motor, and moves to the position shown in FIG. 7 below the reference position H.

After the sheet S reaches the nip section N, the first guide member 45 rotates downwardly. Therefore, even if the sheet S is curved in a downwardly convex manner for the purpose of the correction of the skew, the curved part of the sheet S is prevented from rubbing against the first lower guide section 47. Therefore, the rubbing noise generated by rubbing against the first guide member 45 at the time of sheet skew correction is reduced. In addition, since the upper guide surface 51*a* of the second guide member 51 (see FIG. 5) is concave, the curved part of the sheet S does not rub against the upper guide surface 51*a*, and the rubbing noise is reduced.

After the sheet S reaches the nip section N, the first guide member 45 rotates downwardly, and the send-out opening 45*a* is thereby moved downwardly. Thus, when, after the skew of the sheet S is corrected, the sheet S is fed by rotation of the registration roller pair 12, the sheet S is prevented from coming into contact with the edge of the send-out opening 45*a*. Therefore, the rubbing noise generated by the rubbing of the sheet S against the edge of the send-out opening 45*a* may be reduced.

As shown in FIG. 8, in the case where the sheet S is fed from the horizontal transport path 33, when the passage of the sheet S through the horizontal transport path 33 is detected by a sheet detecting member 58 including a photosensor, a cantilever, or the like located in the horizontal transport path 33, the second guide member 51 is caused to rotate upwardly about the rotation axis 52 driven by a drive source such as a motor (not shown), and the end of the upper guide surface 51*a* stops at a retracted position as shown in FIG. 8. The first guide member 45 is caused to rotate by a drive source such as a motor (not shown) about the rotation center OZ between the lower rotational position and the upper rotational position, and stops at the position shown in FIG. 9 (reference position H).

Therefore, when the second guide member 51 is stopped at the retracted position, the sheet S is fed by rotation of the horizontal transport roller pair 41 (see FIG. 8), while being guided by the horizontal guide members 37 (see FIG. 8), from the horizontal transport path 33 to the confluence transport path 44. The sheet S fed to the confluence transport path 44 comes into contact with the first upper guide section 46 of the first guide member 45 at a relatively small angle. Thus, the collision noise generated when the sheet S comes into contact with the first upper guide section 46 can be reduced.

The rotation of the first guide member 45 to the reference position H moves the send-out opening 45*a* to a predetermined position. At this time, the first guide member 45 rotates such that the send-out opening 45*a* moves to a position between the position of the send-out opening 45*a* in the case where the sheet S is fed from the upper transport path 32 (for example, FIG. 3) and the position of the send-out opening 45*a* in the case where the sheet S is fed from the lower transport path 31 (for example, FIG. 6). Thus, the sheet S guided by the first upper guide section 46 and sent through the send-out opening 45*a* comes into contact with the driving roller 12*a* of the registration roller pair 12 at a relatively small angle. Therefore, the collision noise generated when the sheet S comes into contact with the driving roller 12*a* is reduced. Frequent contact of the sheet S with the driven roller 12*b* of the registration roller pair 12 may deteriorate the driven roller 12*b* formed of rubber. If the sheet S comes into contact with a roller having a relatively high frictional coefficient such as a roller made of rubber, the leading edge of the sheet S coming into contact with the roller may be folded. In this embodiment, the sheet S comes into contact with the driving roller 12*a*, which has a relatively low frictional coefficient. Therefore, the damage of the roller due to the contact with the sheet S is less likely to occur, and the leading edge of the sheet S is prevented from being folded.

As described above, a sheet transport device has been proposed that has a plurality of sheet transport paths and in which a guide member is located in the sheet transport direction of each sheet transport path so as to reduce the transport noise generated when a sheet transported from each sheet transport path comes into contact with a registration roller pair and undergoes deflection, and two elastic films are located so as to be in contact with the guide member. However, in such a sheet transport device, when the sheet is transported to a guide member immediately in front of the registration roller pair where the plurality of sheet transport paths merge, transport noise is generated between the guide member and the sheet. A sheet transport device has also been proposed in which a movable guide capable of being bent like a loop is provided on the upstream side of a registration roller pair. However, in these proposed sheet transport devices, when a sheet fed from a sheet transport path comes into contact with the registration roller pair, transport noise may be generated between the sheet and the registration roller pair.

As described above, according to an embodiment of the present disclosure, a sheet transport device 90 capable of reducing the occurrence of transport noise accompanying the feeding of a sheet to a registration section in a confluence transport path where a plurality of sheet transport paths merge, and an image forming apparatus 100 including the same are provided.

That is to say, according to an embodiment of the present disclosure, when the sheet S is fed from the first sheet transport path (for example, the lower transport path 31) to the confluence transport path 44, and is then fed through the confluence transport path 44 toward the send-out opening 45*a*, the first guide member 45 rotates about the rotation center on the side of the registration section (for example, the registration roller pair 12) toward the first sheet transport path, and therefore the sheet S comes into contact with the first guide member 45 at a relatively small angle. Therefore, the collision noise generated by the collision of the sheet S with the first guide member 45 is reduced. The sheet guided by the first guide member 45 is sent through the send-out opening 45*a* to the registration section. The send-out opening 45*a* rotates together with the first guide member 45 toward the first sheet transport path. Therefore, the sheet S comes into contact with the registration section at a relatively small angle. Therefore, the collision noise generated by the collision of the sheet S with the registration section is reduced. When the sheet S is fed from the second sheet transport path (for example, the upper transport path 32) to the confluence transport path 44, and is then fed through the confluence transport path 44 toward the send-out opening 45*a*, the first guide member 45 rotates about the rotation center on the side of the registration section toward the second sheet transport path, and therefore the sheet S comes into contact with the first guide member 45 at a relatively small angle. Therefore, the collision noise generated by the collision of the sheet S with the first guide member 45 is reduced. The sheet S guided by the first guide member 45 is sent through the send-out opening 45*a* to the registration section. The send-out opening 45*a* rotates together with the first guide member 45 toward the second sheet transport path. Therefore, the sheet S comes into contact with the registration section at a relatively small angle. Therefore, the collision noise generated by the collision of the sheet S with the registration section is reduced.

In the above embodiment, the present disclosure is applied to a sheet transport device 90 in which a registration roller pair 12 feeds a sheet S in a horizontal direction and that includes a lower transport path 31 that feeds a sheet S from below, an upper transport path 32 that feeds a sheet S from above, and a horizontal transport path 33 that feeds a sheet S from a substantially horizontal direction. The present disclosure is not limited to this and may be applied to, for example, a sheet transport device 90 in which a registration roller pair 12 feeds a sheet S in a vertical direction and that includes a sheet transport path that feeds a sheet S from both sides in a horizontal direction, and a sheet transport path that feeds a sheet S in a vertical direction. According to the arrangement of the paper cassette 3, the manual paper feed tray 5, a paper feed section used in duplex printing, or an external paper feed section relative to the registration roller pair 12, the sheet transport paths of these paper feed sections are set in a horizontal direction or a vertical direction.

In the above embodiment, the sheet transport device 90 includes the transport paths 31 to 33, the first guide member 45 and the stationary guide member 48 forming the confluence transport path 44, and the second guide member 51. However, the present disclosure is not limited to this. The sheet transport device 90 may include the transport paths 31 to 33, and the first guide member 45 and the stationary guide member 48 forming the confluence transport path 44 and in this sheet transport device 90, the second guide member 51 described above may not be provided, and the sheet S may be fed from the transport paths 31 to 33 to the confluence transport path 44 not through the second guide member 51.

In the above embodiment, the sheet transport device 90 is used with an ink-jet printer 100. However, the present disclosure is not limited to this. The sheet transport device 90 may be used with an image forming apparatus such as an electrophotographic printer, a copying machine, a fax machine, or a complex machine of them.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent apparatuses and methods within the scope of the disclosure, in addition to those enumerated herein, will be apparent to those skilled in the art from the foregoing descriptions. Such modifications and variations are intended to fall within the scope of the appended claims.

The invention is claimed as follows:

1. A sheet transport device comprising:

a registration section configured to cause a leading edge of a sheet to come into contact with the registration section, thereby stop the sheet, and then feed the sheet again at a predetermined timing;

a first sheet transport path configured to feed the sheet from one of two transport directions substantially perpendicular to the sheet transport direction of the registration section;

a second sheet transport path configured to feed the sheet from the other of the two transport directions substantially perpendicular to the sheet transport direction;

a confluence transport path configured to merge the first sheet transport path and the second sheet transport path on an upstream side of the registration section in the sheet transport direction; and a first guide member located so as to form the confluence transport path such that a space in the confluence transport path becomes smaller from the upstream side toward a downstream side in the sheet transport direction and rotatable about a rotation center on a side of the registration section to the downstream side of the first guide member in the sheet transport direction, and the first guide member rotates toward the first sheet transport path when the sheet is fed from the first sheet transport path to the confluence transport path, and rotates toward the second sheet transport path when the sheet is fed from the second sheet transport path to the confluence transport path.

2. The sheet transport device according to claim 1, comprising a send-out opening formed in the first guide member and facing the registration section on the downstream side in the sheet transport direction of the first guide member and configured so as to send the sheet to the registration section, the registration section has a first roller, and a second roller pressed against the first roller, forming a nip section that nips and feeds the sheet, the first roller has a surface friction coefficient lower than a surface friction coefficient of the second roller, and the sheet sent through the send-out opening to the registration section comes into contact with the first roller and then enters the nip section.

3. The sheet transport device according to claim 1, wherein when the registration section feeds the sheet stopped at the registration section again, the first guide member rotates toward the second sheet transport path when the sheet is fed from the first sheet transport path to the confluence transport path, and rotates toward the first sheet transport path when the sheet is fed from the second sheet transport path to the confluence transport path.

4. The sheet transport device according to claim 1, comprising a third sheet transport path that feeds the sheet from substantially the same direction as the sheet transport direction of the registration section to the confluence transport path, and when the sheet is fed from the third sheet transport path to the confluence transport path, the first guide member is located between a rotational position on a side of the first sheet transport path and a rotational position on a side of the second sheet transport path.

5. The sheet transport device according to claim 1, comprising a second guide member located on the upstream side of the first guide member in the sheet transport direction, the second guide member including a first guide surface configured to guide the sheet fed from the first sheet transport path toward the first guide member, and a second guide surface formed on an opposite side to the first guide surface and configured to guide the sheet fed from the second sheet transport path toward the first guide member, the second guide member being rotatable about a rotation center on the upstream side in the sheet transport direction of the confluence transport path, when the sheet is fed from the first sheet transport path, the second guide member rotates toward the second sheet transport path and guides the sheet with the first guide surface toward the first guide member, and when the sheet is fed from the second sheet transport path, the second guide member rotates toward the first sheet transport path and guides the sheet with the second guide surface toward the first guide member.

6. The sheet transport device according to claim 5, wherein at least one of the first guide surface and the second guide surface is concave.

7. The sheet transport device according to claim 1, wherein the registration section feeds the sheet in a horizontal direction, one of the first sheet transport path and the second sheet transport path feeds the sheet to the confluence transport path from a lower part of an apparatus main body, and the other of the first sheet transport path and the second sheet transport path feeds the sheet to the confluence transport path from an upper part of the apparatus main body.

8. The sheet transport device according to claim 1, comprising a send-out opening formed in the first guide member facing the registration section on the downstream side in the sheet transport direction of the first guide member and configured to send the sheet to the registration section, a third sheet transport path that feeds the sheet from substantially the same direction as the sheet transport direction of the registration section to the confluence transport path, the first guide member is located at a reference position between a first rotational position to which the first guide member rotates when the sheet is fed from the first sheet transport path to the confluence transport path and a second rotational position to which the first guide member rotates when the sheet is fed from the second sheet transport path to the confluence transport path, when the first guide member is located at the first rotational position, the send-out opening is located nearer to the first transport path than when the first guide member is located at the reference position, and when the first guide member is located at the second rotational position, the send-out opening is located nearer the second transport path than when the first guide member is located at the reference position.

9. The sheet transport device according to claim 1, wherein at least one of an angle at which the sheet comes into contact with the first guide member when the sheet is fed from the first sheet transport path to the confluence transport path and an angle at which the sheet comes into contact with the first guide member when the sheet is fed from the second sheet transport path to the confluence transport path is 40° or less.

10. The sheet transport device according to claim 1, wherein at least one of an angle at which the sheet comes into contact with the first guide member when the sheet is fed from the first sheet transport path to the confluence transport path and an angle at which the sheet comes into contact with the first guide member when the sheet is fed from the second sheet transport path to the confluence transport path is 30° or less.

11. An image forming apparatus comprising:

a recording section; and a sheet transport device including a registration section configured to cause a leading edge of a sheet to come into contact with the registration section, thereby stop the sheet, and then feed the sheet again at a predetermined timing, a first sheet transport path configured to feed the sheet from one of two transport directions substantially perpendicular to the sheet transport direction of the registration section, a second sheet transport path configured to feed the sheet from the other of the two transport directions substantially perpendicular to the sheet transport direction, a confluence transport path configured to merge the first sheet transport path and the second sheet transport path on an upstream side of the registration section in the sheet transport direction, and a first guide member located so as to form the confluence transport path such that a space in the confluence transport path becomes smaller from the upstream side toward a downstream side in the sheet transport direction and rotatable about a rotation center on a side of the registration section to the downstream side of the first guide member in the sheet transport direction, and the first guide member rotates toward the first sheet transport path when the sheet is fed from the first sheet transport path to the confluence transport path, and rotates toward the second sheet transport path in the case where the sheet is fed from the second sheet transport path to the confluence transport path.

12. The image forming apparatus according to claim 11, wherein the sheet transport device includes a send-out opening formed in the first guide member and facing the registration section on the downstream side in the sheet transport direction of the first guide member and configured so as to send the sheet to the registration section, the registration section has a first roller, and a second roller pressed against the first roller, forming a nip section that nips and feeds the sheet, the first roller has a surface friction coefficient lower than a surface friction coefficient of the second roller, and the sheet sent through the send-out opening to the registration section comes into contact with the first roller and then enters the nip section.

13. The image forming apparatus according to claim 11, wherein when the registration section feeds the sheet stopped at the registration section again, the first guide member rotates toward the second sheet transport path when the sheet is fed from the first sheet transport path to the confluence transport path, and rotates toward the first sheet transport path when the sheet is fed from the second sheet transport path to the confluence transport path.

14. The image forming apparatus according to claim 11, wherein the sheet transport device further includes a third sheet transport path that feeds the sheet from substantially the same direction as the sheet transport direction of the registration section to the confluence transport path, and when the sheet is fed from the third sheet transport path to the confluence transport path, the first guide member is located between a rotational position on a side of the first sheet transport path and a rotational position on a side of the second sheet transport path.

15. The image forming apparatus according to claim 11, wherein the sheet transport device includes a second guide member located on the upstream side of the first guide member in the sheet transport direction, the second guide member including a first guide surface configured to guide the sheet fed from the first sheet transport path toward the first guide member, and a second guide surface formed on an opposite side to the first guide surface and configured to guide the sheet fed from the second sheet transport path toward the first guide member, the second guide member being rotatable about a rotation center on the upstream side in the sheet transport direction of the confluence transport path, when the sheet is fed from the first sheet transport path, the second guide member rotates toward the second sheet transport path and guides the sheet with the first guide surface toward the first guide member, and when the sheet is fed from the second sheet transport path, the second guide member rotates toward the first sheet transport path and guides the sheet with the second guide surface toward the first guide member.

16. The image forming apparatus according to claim 15, wherein at least one of the first guide surface and the second guide surface is concave.

17. The image forming apparatus according to claim 11, wherein the registration section feeds the sheet in a horizontal direction, one of the first sheet transport path and the second sheet transport path feeds the sheet to the confluence transport path from a lower part of an apparatus main body, and the other of the first sheet transport path and the second sheet transport path feeds the sheet to the confluence transport path from an upper part of the apparatus main body.

18. The image forming apparatus according to claim 11, wherein the sheet transport device further includes a send-out opening formed in the first guide member facing the registration section on the downstream side in the sheet transport direction of the first guide member and configured to send the sheet to the registration section, and a third sheet transport path that feeds the sheet from substantially the same direction as the sheet transport direction of the registration section to the confluence transport path, the first guide member is located at a reference position between a first rotational position to which the first guide member rotates when the sheet is fed from the first sheet transport path to the confluence transport path and a second rotational position to which the first guide member rotates when the sheet is fed from the second sheet transport path to the confluence transport path, when the first guide member is located at the first rotational position, the send-out opening is located nearer to the first transport path than when the first guide member is located at the reference position, and when the first guide member is located at the second rotational position, the send-out opening is located nearer the second transport path than when the first guide member is located at the reference position.

19. The image forming apparatus according to claim 11, comprising a paper feed section in which a plurality of sheets are loaded and stored, a reversing transport path where the sheet is reversed when recording is performed on a first surface of the sheet by the recording section and then recording is performed on a second surface on the opposite side from the first surface, and a manual paper feed tray located outside the apparatus main body, the sheet transport device includes a third sheet transport path that feeds the sheet from substantially the same direction as the sheet transport direction of the registration section to the confluence transport path, one of the first sheet transport path and the second sheet transport path feeds the sheet fed from the paper feed section, the other of the first sheet transport path and the second sheet transport path feeds the sheet fed from the reversing transport path, and the third sheet transport path feeds the sheet fed from the manual paper feed tray.

* * * * *